US008752935B2

(12) United States Patent
Yamamoto et al.

(10) Patent No.: US 8,752,935 B2
(45) Date of Patent: Jun. 17, 2014

(54) LIQUID EJECTION DEVICE

(71) Applicant: Seiko Epson Corporation, Tokyo (JP)

(72) Inventors: Takao Yamamoto, Nagano (JP); Hirotaka Yoshida, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/762,863

(22) Filed: Feb. 8, 2013

(65) Prior Publication Data

US 2013/0208049 A1 Aug. 15, 2013

(30) Foreign Application Priority Data

Feb. 14, 2012 (JP) ..... 2012-029183

(51) Int. Cl.
*B41J 13/00* (2006.01)

(52) U.S. Cl.
USPC ..... 347/37; 347/85

(58) Field of Classification Search
USPC ..... 347/9–12, 15, 16, 20, 37, 40–43, 347/49–50, 89, 90, 102, 104
See application file for complete search history.

(56) References Cited

U.S. PATENT DOCUMENTS

| | | | |
|---|---|---|---|
| 6,270,215 | B1 | 8/2001 | Miyasaka et al. |
| 6,927,841 | B2 | 8/2005 | Hinojosa et al. |
| 7,144,106 | B2 | 12/2006 | Ishii et al. |
| 7,322,690 | B2 | 1/2008 | Ishii et al. |
| 7,887,179 | B2 | 2/2011 | Toyoshima |
| 2011/0074872 | A1 | 3/2011 | Ozaki et al. |
| 2011/0221843 | A1 | 9/2011 | Ozaki |
| 2013/0002749 | A1* | 1/2013 | Masuda ..... 347/16 |

FOREIGN PATENT DOCUMENTS

| | | | |
|---|---|---|---|
| JP | 06-015902 | A | 1/1994 |
| JP | 08-156351 | A | 6/1996 |
| JP | 11-208045 | A | 8/1999 |
| JP | 2001-347691 | A | 12/2001 |
| JP | 2001-347710 | A | 12/2001 |
| JP | 2002-120420 | A | 4/2002 |
| JP | 2003-118180 | A | 4/2003 |
| JP | 2003-118181 | A | 4/2003 |
| JP | 2003-118182 | A | 4/2003 |
| JP | 2003-246524 | A | 9/2003 |
| JP | 2005-219434 | A | 8/2005 |
| JP | 2006-181939 | A | 7/2006 |
| JP | 2006-192836 | A | 7/2006 |
| JP | 2006-231612 | A | 9/2006 |
| JP | 2007-098936 | A | 4/2007 |
| JP | 2007-152737 | A | 6/2007 |

(Continued)

*Primary Examiner* — Thinh Nguyen
(74) *Attorney, Agent, or Firm* — Global IP Counselors, LLP

(57) ABSTRACT

A liquid ejection device includes a transport unit, a medium support unit, a liquid ejection head and a negative pressure generating unit. The medium support unit is arranged on a downstream side of the transport unit, and has a medium support surface on which the ejection medium is supported by suction using negative pressure. The medium support unit includes a plurality of first and second recesses arranged on the medium support surface and aligned in a width direction orthogonal to a transport direction. The first recesses are in communication with the negative pressure generating unit. The second recesses are configured and arranged to accept the liquid ejected from the liquid ejection head. Each of the second recesses includes a communication unit communicating with one of the first recesses and a vent hole configured and arranged to allow ventilation without being in communication with the negative pressure generating unit.

7 Claims, 7 Drawing Sheets

(56) References Cited

FOREIGN PATENT DOCUMENTS

| | | | |
|---|---|---|---|
| JP | 2007-260913 | A | 10/2007 |
| JP | 2007-331255 | A | 12/2007 |
| JP | 2009-067015 | A | 4/2009 |
| JP | 2009-119778 | A | 6/2009 |
| JP | 2010-000694 | A | 1/2010 |
| JP | 2010-137399 | A | 6/2010 |
| JP | 2010-269456 | A | 12/2010 |
| JP | 2010-269609 | A | 12/2010 |
| JP | 2011-046110 | A | 3/2011 |
| JP | 2011-088424 | A | 5/2011 |
| JP | 2011-189539 | A | 9/2011 |

* cited by examiner

LIQUID EJECTION DEVICE

CROSS-REFERENCE TO RELATED APPLICATIONS

This application claims priority to Japanese Patent Application No. 2012-029183 filed on Feb. 14, 2012. The entire disclosure of Japanese Patent Application No. 2012-029183 is hereby incorporated herein by reference.

BACKGROUND

1. Technical Field

The present invention relates to a liquid ejection device for ejecting a liquid on an ejection medium that is supported by suction on a medium support unit.

2. Related Art

From the past, inkjet printers (hereafter referred to simply as "printers") have been put to practical use as liquid ejection devices for ejecting ink as a liquid from a liquid ejection head onto paper as one type of ejection medium in a sheet form that is transported while being supported on a medium support unit, and forming an image containing text or graphics. This type of printer has a plurality of recesses that open at a medium support surface that the medium support unit has, and that are depression formed so as to be separated from the paper supported on that medium support surface, and by suction of the paper by the negative pressure given to these recesses, the paper is supported by suction on the medium support unit.

With this kind of printer, there are cases when so-called "borderless printing" is performed, by which ink is ejected from the liquid ejection head onto the entire surface of the paper to form an image. When performing this kind of "borderless printing," recesses which accept ink ejected from the liquid ejection head outside of the width direction end parts of the paper are provided such that the paper end parts are positioned inside the openings thereof. Because of that, at the recesses at which ink is ejected, there are opening parts on the medium support surface which are not covered by paper, and due to negative pressure that suctions the paper, there is a flow of air (atmosphere) that is suctioned to the recesses via this opening part.

At this time, due to the air suctioned to the recesses from the top surface (image forming surface) side of the paper, it is possible for flight interference to occur, by which the flight of ink ejected on the paper is curved. In light of that, for example as disclosed in Japanese Laid-Open Patent Application Publication No. 2005-219434, it is proposed to have the recesses and the pressure chamber side be in communication using a flow path of a shape for which the recess (vent hole) opening surface area gradually decreases and then becomes fixed as it faces the pressure chamber side that gives negative pressure for suctioning the paper. By having the pressure chamber and the recesses be in communication in this way, unnecessary ink ejected into the recesses is flowed to the pressure chamber, and also, it is possible to increase the flow path resistance during suction on the pressure chamber side at the recesses, so it is possible to reduce the flow speed of air suctioned to the recesses. As a result, in the liquid ejection area which is the image forming surface side (top surface side) area of the paper on which ink is ejected toward the paper from the liquid ejection head, the constitution is such that the flow speed of the air that flows due to suction is weakened, the flight interference of ejected ink is suppressed, and unnecessary ink is accepted using suction.

SUMMARY

However, with the constitution of the medium support unit disclosed in the above mentioned publication, though its flow speed is weakened, the air suctioned to the recesses continues to flow from the top side of the paper, specifically, the liquid ejection area side. Because of that, the ink flight interference due to air flowing from the liquid ejection area side continues to occur, and things such as ink impact displacement and the like occur. Therefore, there is a desire for technology that accepts ink ejected to the medium support unit outside the paper while suppressing ink flight interference.

The present invention was created considering the circumstances noted above, and an object is to provide a liquid ejection device for which it is possible to accept liquid ejected to the medium support unit outside the recording medium while suppressing liquid flight interference.

A liquid ejection device according to one aspect includes a transport unit, a medium support unit, a liquid ejection head and a negative pressure generating unit. The transport unit is configured and arranged to transport an ejection medium. The medium support unit is arranged on a downstream side of the transport unit with respect to a transport direction of the ejection medium, and has a medium support surface on which the ejection medium is supported by suction using negative pressure. The liquid ejection head is configured and arranged to eject liquid on the ejection medium supported on the medium support unit. The negative pressure generating unit is configured and arranged to generate the negative pressure to the medium support unit. The medium support unit includes a plurality of first recesses and a plurality of second recesses. The first recesses are arranged on the medium support surface with the first recesses being in communication with the negative pressure generating unit. The second recesses are arranged on the medium support surface so that the first recesses and the second recesses are aligned in a width direction orthogonal to a transport direction. The second recesses are configured and arranged to accept the liquid ejected from the liquid ejection head. Each of the second recesses includes a communication unit communicating with one of the first recesses and a vent hole configured and arranged to allow ventilation without being in communication with the negative pressure generating unit.

With this arrangement, the air suctioned at the second recess, after mainly flowing into inside the second recess from the vent hole positioned at the bottom surface side of the ejection medium which is different from the liquid ejection area side (ejection medium top surface side), flows into inside the first recess through the communication unit from the second recess, and after that, flows from the first recess to the negative pressure generating unit side. Because of that, in addition to accepting the liquid at the second recess, there is a decrease in the air pulled to the second recess from the liquid ejection area side. Therefore, it is possible to accept the liquid ejected to the medium support unit outside of the recording medium while suppressing liquid flight interference.

With the liquid ejection device of the above described aspect, the vent hole is preferably arranged on an upstream side in the second recess with respect to the transport direction.

With this arrangement, at the upstream side of the transport direction of the liquid ejection area, a flow of the air from the vent hole occurs in the direction flowing out from the second recess to the downstream side of the transport direction, so it is possible to suppress the pulling of the mist form liquid that occurs at the downstream side of the transport direction of the liquid ejection area to the second recess positioned at the upstream side.

With the liquid ejection device of the above described aspect, the vent hole preferably serves as a discharge port for discharging the liquid accepted by the second recess from the second recess.

With this arrangement, it is possible to suppress the liquid ejected on the second recess from being suctioned to the first recess in communication with the second recess, so it is possible to suppress soiling of the medium support surface by the liquid.

With the liquid ejection device of the above described aspect, the medium support unit preferably further includes a flow path tube connected to the vent hole and through which the liquid discharged from the second recess flows, and the flow path tube preferably has a taper shaped area in which a cross section area of a flow path of the flow path tube becomes smaller as a distance from the vent hole becomes larger.

With this arrangement, it is possible to adjust the flow path resistance of the air suctioned from the flow path tube, so it is possible to adjust the volume of air flowing from the vent hole via the second recess to the first recess.

With the liquid ejection device of the above described aspect, the flow path tube preferably includes an absorptive material disposed inside the flow path tube, the absorptive material being in communication with the second recess to absorb the liquid discharged from the vent hole.

With this arrangement, the liquid ejected from the liquid ejection head to the second recess can reliably flow to the downstream side separating from the vent hole inside the flow path tube without the occurrence of reverse flow together with air from the flow path tube side to the vent hole side. Therefore, it is possible to reliably accept ink ejected at the second recess.

With the liquid ejection device of the above described aspect, at least one of the first recesses preferably includes a vacuum hole in communication with the negative pressure generating unit, and the vacuum hole, the communication unit, and the vent hole are arranged generally along a straight line when viewed along a normal line direction of the medium support surface.

With this arrangement, the air suctioned from the vent hole flows smoothly through the communication hole to the vacuum hole, so it is possible to reduce the air pulled from the liquid ejection area.

With the liquid ejection device of the above described aspect, the vent hole is preferably disposed at a position that at least partially overlaps the ejection medium when viewed along a normal line direction of the medium support surface.

With this arrangement, air flows at the bottom surface side which is opposite to the top surface side which becomes the liquid ejection area side in relation to the ejection medium, so it is possible to reduce the air pulled from the top surface side, specifically, the liquid ejection area side.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
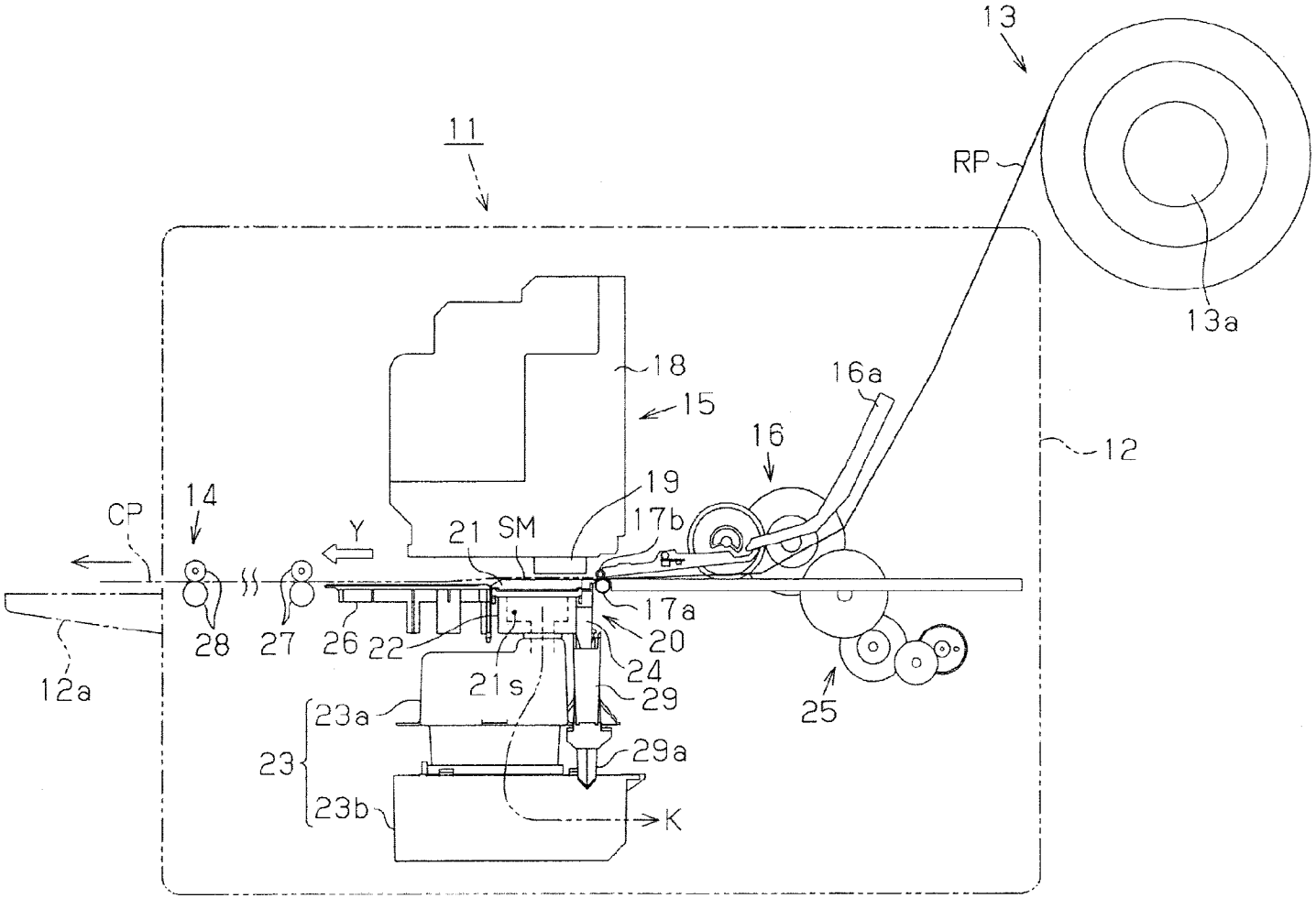
FIG. 1 is a schematic block diagram of a liquid ejection device which is an embodiment of the present invention.

Following, as an embodiment with the present invention in a specific example, we will describe an inkjet printer (hereafter referred to simply as "printer") as an example of a liquid ejection device, equipped with a liquid ejection head for ejecting liquid, for forming (printing) an image or the like containing text or graphics by ejecting liquid on paper (roll paper) as an ejection medium, while referring to the drawings.

As shown in FIG. 1, the printer 11 has a main unit case 12, and a paper supply unit 13 with the long sheet form paper RP supplied to the main unit case 12 equipped in a rolled state. Equipped inside the main unit case 12 are a liquid ejection unit 15 that ejects liquid on the supplied paper RP to form an image or the like, and a paper ejection unit 14 for ejecting from a paper ejection port provided on the main unit case 12 to a paper ejection tray 12*a* the paper RP on which an image or the like is formed as cut paper CP.

The paper supply unit 13 is equipped so that the paper RP is able to rotate with a roll shaft 13*a* at the center on the side opposite to the paper ejection unit 14, and supplies the paper RP into the main unit case 12. Inside the main unit case 12 is provided a transport path 16 equipped with a guide member 16*a* or the like by which the end part of the paper RP is guided. The end part of the paper RP which is supplied unwound from its rolled state as the roll shaft 13*a* is rotated is transported along this transport path 16, and in the transport path 16, is fed between a pair of rollers consisting of a paper feed roller 17*a* provided at the downstream end of the transport direction Y (white outline arrow direction in the drawing) of the transport path 16 and a paper pressing roller 17*b* which is driven by the rotation of this paper feed roller 17*a*. While being sandwiched by the paper feed roller 17*a* driven by a drive source (motor, not illustrated) and the paper pressing roller 17*b*, the paper RP is transported to the liquid ejection unit 15 side which is positioned at the transport direction Y downstream side. Therefore, with this embodiment, the paper feed roller 17*a* and the paper pressing roller 17*b* function as a transport unit.

The liquid ejection unit 15 is equipped with a carriage 18 on the upper side (antigravity direction side) of the transported paper RP. The carriage 18 is supported on a guide shaft (not illustrated) that is erected within the main unit case 12 in a state extending in a generally horizontal direction along the width direction of the paper RP orthogonal to the transport direction (direction between the paper front side and back side in FIG. 1), and is able to move along the guide shaft. A liquid ejection head 19 is attached to the bottom surface side facing opposite the paper RP transported to the carriage 18. A plurality of nozzles (not illustrated) for ejecting ink which is an example of the liquid are provided on the liquid ejection head 19, and by the carriage 18 moving back and forth along the width direction of the paper RP while being guided by the guide shaft, these move back and forth together with the carriage 18 in the direction along the guide shaft (also called the main scan direction X).

Also, the printer 11 is equipped with a medium support unit 20 that sandwiches the transported paper RP and supports the paper RP from the lower side (gravity direction side) at a position facing the liquid ejection head 19. The medium support unit 20 is equipped with a generally rectangular shaped surface for which the main scan direction X is the long direction on the top surface facing opposite the liquid ejection head 19, and the paper RP is supported by suction on this top surface by negative pressure given to the medium support unit 20.

Specifically, the medium support unit 20 is equipped on its top surface with a generally plate shaped support surface forming member 21 formed as a medium support surface SM supporting the paper RP transported in the transport direction Y, and a support unit frame member 22 joined and fixed to the bottom surface side which is the side opposite to the medium support surface SM. Then, an interior space is formed by the joined support surface forming member 21 and the support unit frame member 22, and this interior space functions as a negative pressure chamber 21*s* to which negative pressure is given in order to suction the paper RP to the medium support surface SM.

Also, with this embodiment, a negative pressure generating unit 23 connected so as to be in communication with the negative pressure chamber 21*s*, consisting of a suction chamber 23*a* for suctioning air from the negative pressure chamber 21*s* and a rotating fan 23*b*, is provided on the bottom side of the medium support unit 20. Therefore, the negative pressure generated at the negative pressure generating unit 23 by the air (atmosphere) rotated by the rotating fan 23*b* flowing as shown by the double-dot-dash line arrow K in the drawing is given to the negative pressure chamber 21*s*. Then, on the front surface of the paper RP supported by suction on the medium support unit 20 (the top surface in FIG. 1), by ink being ejected from the liquid ejection head 19, formation (printing) of an image or the like is performed by adhering of ink on the paper RP.

Also, inside the main unit case 12, further to the transport direction Y downstream side than the medium support unit 20 (support surface forming member 21), are equipped a guide plate 26 and intermediate roller pair 27 for transporting the paper RP from the medium support unit 20 side to the paper ejection unit 14 side. Further equipped is a paper ejection roller pair 28 for ejecting paper RP from the paper ejection port to the paper ejection tray 12*a*. Provided as necessary between the intermediate roller pair 27 and the paper ejection roller pair 28 are a cutter for cutting the paper RP after image formation to a cut paper CP of a designated length, and further to the transport direction Y downstream side than the cutter, a drying device for drying ink by blowing warm air (drying air) on the printed surface of the cut paper CP, and the like.

Furthermore, with the printer 11, for example in cases such as when exchanging the paper RP with a different paper RP of a different width dimension, reversing the roll shaft 13*a* and returning the paper RP from the liquid ejection unit 15 to the direction opposite to the transport direction Y are performed. At that time, a release mechanism 25 for releasing such that the paper pressing roller 17*a* is separated from the paper feed roller 17*a* is equipped using a gear train or the like.

Now then, as shown in FIG. 1, with the printer 11 of this embodiment, when borderless printing is performed, the flow path tube 24 by which the ink ejected on the medium support unit 20 flows and is discharged is provided on the medium support unit 20. Then, within the main unit case 12, at the downward side which is the gravity direction side of the flow path tube 24, arranged is an ink guiding member 29 for which is provided a gutter shaped part 29*a* (see FIG. 3) which receives ink discharged from the flow path tube 24 and flows it to a waste ink tank (not illustrated).

Then, with this embodiment, the constitution is such that when the paper RP transported on the medium support unit 20 is suctioned to the medium support surface SM, the air suctioned at the medium support surface SM flows to the medium support surface SM side via the flow path tube 24. We will describe this constitution while referring to FIG. 2 through FIG. 5.

Figure 2:
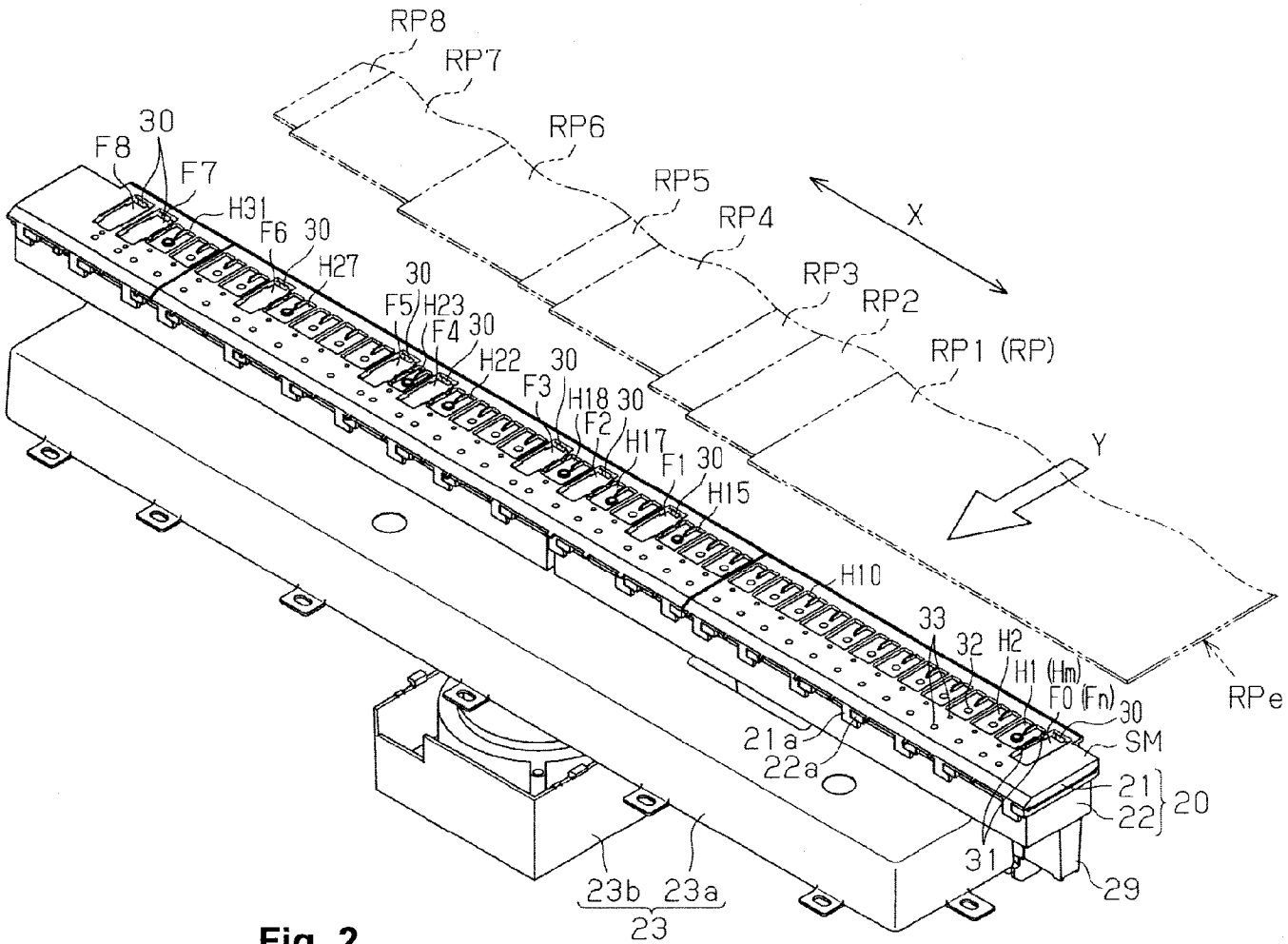
FIG. 2 is a perspective view showing a medium support unit equipped with a liquid ejection device of this embodiment.
Figure 3:
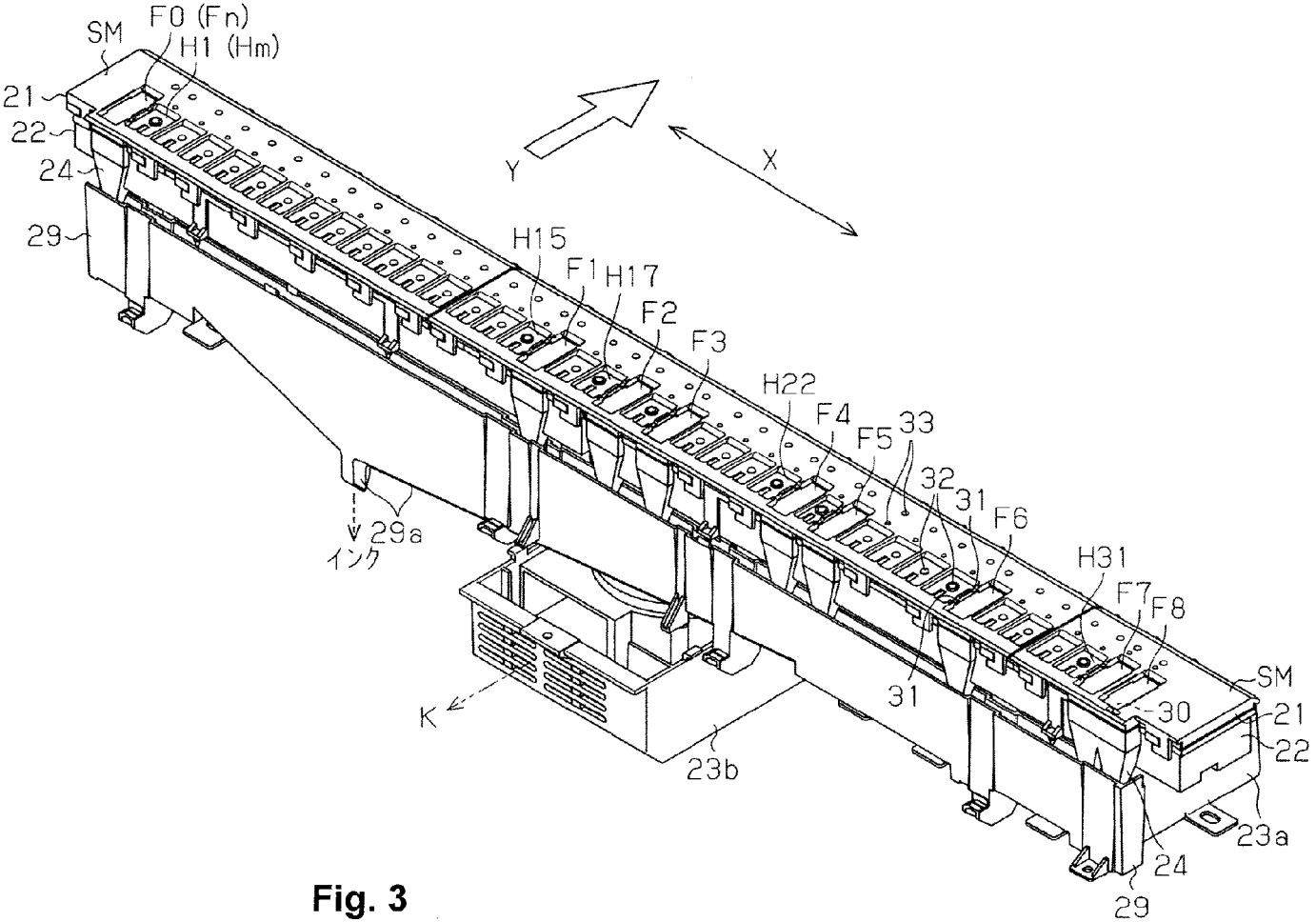
FIG. 3 is a perspective view of a medium support unit equipped with a liquid ejection device of this embodiment seen from the opposite side to that in FIG. 2.

As shown in FIG. 2 and FIG. 3, the medium support unit 20 is formed with a hook shaped member 21*a* provided on a generally plate shaped support surface forming member 21 engaged with a plurality of projection sites 22*a* provided in the vicinity of the opening of a support unit frame member 22 having generally a box shape which opens upward, so that the support surface forming member 21 and the support unit frame member 22 are joined and fixed. Then, the top surface of the support surface forming member 21 functions as the medium support surface SM, and also, the internal space formed by the joined support surface forming member 21 and the support unit frame member 22 functions as the negative pressure chamber 21*s*. Then, the negative pressure generating unit 23 (suction chamber 23*a*) is in communication with this negative pressure chamber 21*s*, and the negative pressure generated by the rotation of the rotating fan 23*b* is given via the suction chamber 23*a*.

On the support surface forming member 21, a plurality of first recesses Hm (m=1 to 31) and second recesses Fn (n=0 to 8), which are respectively formed with designated volume depressions downward so as to be open at the medium support surface SM and also to be separated from the supported paper RP, are provided aligned in the width direction orthogonal to the transport direction Y. With this embodiment, nine second recesses Fn (F0 to F8) that accept ink ejected from the liquid ejection head 19 during borderless printing are provided with a designated interval left open at positions corresponding to the respective width direction end parts of eight types of paper RP (RP1 to RP8) for which the width dimensions differ. Of these, the second recess F0 provided furthest to the left side seen from the upstream side of the transport direction Y is provided at a position for which all the respective end parts RPe of the left side seen from the transport direction Y upstream side correspond in common. Said another way, each paper RP is transported on the medium support unit 20 in a state with all the end parts RPe of one of the papers RP moved to the left side seen from the transport direction Y upstream side so as to all be at the same position. With the first recesses Hm and the second recesses Fn, the depression formed part at the downstream side edge of the transport direction Y of the respective openings is a slope shape so that the paper RP is transported smoothly.

On each of the first recesses Hm provided on the medium support surface SM in this way, a vacuum hole 32 in communication with the negative pressure chamber 21*s* is provided, and each first recess Hm is in communication with the negative pressure generating unit 23 by which negative pressure is generated via this vacuum hole 32. Also, each second recess Fn is in communication with the adjacent first recess Hm on the inside of the paper RP covered by the paper RP via a groove part 31 formed at a designated volume downward from the medium support surface SM, and the negative pressure of the negative pressure chamber 21*s* is given to the depression formed part of the first recess Hm via this groove part 31. Therefore, the groove part 31 functions as a communication unit between the first recesses Hm and the second recesses Fn, and the paper RP is suctioned, including its end part, by the first recesses Hm and the second recesses Fn.

At the transport direction Y upstream side end part of the depression formed part of each second recess Fn, vent holes capable of ventilation from the bottom surface side of the side opposite the medium support surface SM side are provided in a generally rectangular shape with the width direction as the long direction on the support surface forming member 21. As shown in FIG. 3, flow path tubes 24 provided at the transport direction Y upstream side are respectively connected to the vent holes 30.

With the flow path tube 24, on the interior, a through path 40 (see FIG. 5) is formed as a flow path by which the ink flows downward which is the gravity direction from the vent hole 30, and by the ink ejected on the second recess Fn flowing in this through path 40, it is discharged to an ink guiding member 29 provided downward of the flow path tube 24. The ink guiding member 29 is formed having a gutter shaped part 29*a* (see FIG. 5) which has a designated gradient, and ink is discharged to a waste ink tank (not illustrated) from a portion (bottom part) of the gutter shaped part 29*a*. Therefore, the vent hole 30 functions as a discharge port for discharging ink accepted by the second recess Fn during borderless printing from the depression formed part of the second recess Fn.

Also, with this embodiment, the through path 40 formed inside the flow path tube 24 is a flow path that is not communication with the negative pressure generating unit 23, and functions as a flow path for which air can flow through this through path 40 toward the vent hole 30 which is in the reverse direction of the ink flow. We will give a detailed description of the constitution of this flow path tube 24 including the constitution of the medium support unit 20 while referring to FIG. 4 and FIG. 5. Here, as an example, we will describe the constitution of the flow path tubes 24 connected with the vent holes 30 respectively provided on the second recesses F1 to F3. Therefore, in FIG. 4 and FIG. 5, both end parts of the medium support unit 20 are omitted from the illustration. Of course, each second recess Fn respectively has the same constitution.

Figure 4:
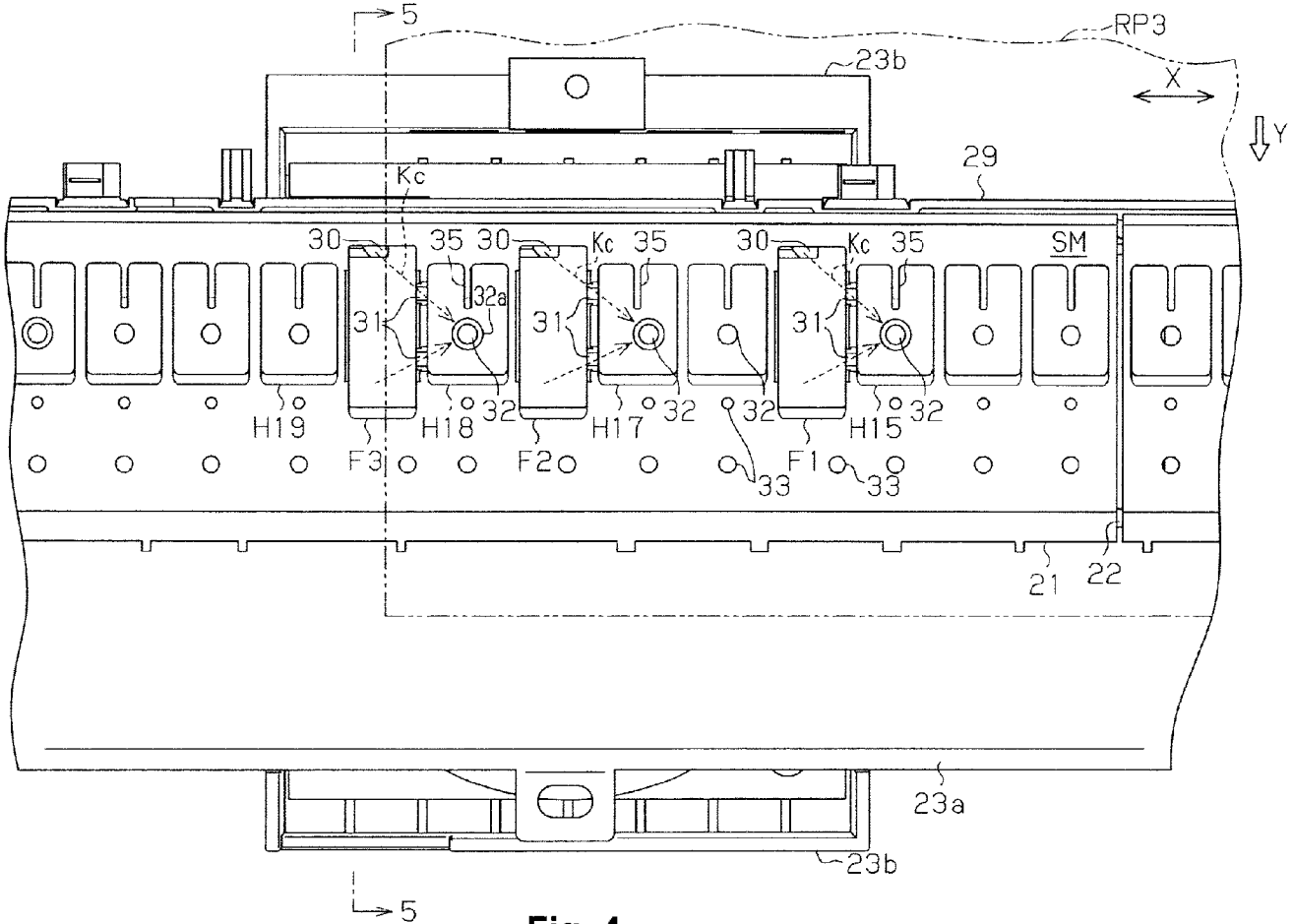
FIG. 4 is a plan view showing a state with the medium support unit and the negative pressure generating unit partially enlarged.

As shown in FIG. 4, at the second recess F3 provided at a position corresponding to the end part of the width direction (main scan direction X) of the paper RP3 (not illustrated) transported on the medium support surface SM, provided at its depression formed part is a vent hole 30 at the side separated from the paper RP3 which is the upstream side of the transport direction Y (white outline arrow in the drawing). Also, at the belt shaped medium support surface SM part formed between the depression formed part of this second recess F3 and the depression formed part of the adjacent first recess H19 on the inside of the paper RP3, two groove parts 31 lowered by a designated volume from the medium support surface SM and having a designated length in the transport direction Y are formed. Of these two groove parts 31, the groove part 31 positioned at the transport direction Y upstream side is formed at a position on a generally straight line connecting the vacuum hole 32 formed on the first recess H15 and the vent hole 30, as shown by the dotted line arrow Kc in the drawing.

Similarly, for the second recesses F1 and F2 respectively provided at the positions corresponding to the end parts of the width direction of the transported papers RP1 and RP2, vent holes 30 are respectively provided on the side separated from the papers RP1 and RP2, which is the upstream side of the transport direction Y (white outline arrow in the drawing) of the depression formed part. Also, at the belt shaped medium support surface SM formed between the depression formed part of this second recess F1 and F2 and the depression formed part of the respectively adjacent first recesses H15 and H17 on the inside of the papers RP1 and RP2, two groove parts 31 are respectively formed lowered by a designated volume from the medium support surface SM and having a designated length in the transport direction Y. Of the two groove parts 31, the groove part 31 positioned on the transport direction Y upstream side is formed at a position above a generally straight line connecting the respective vacuum holes 32 formed on the first recesses H15 and H17 and the vent hole 30 as shown by the dotted line arrow Kc in the drawing.

With this embodiment, ribs 35 are provided extending from the transport direction Y upstream side edge at the opening of the first recess Hm toward the transport direction Y downstream side. With the ribs 35, the transport direction Y upstream side at the opening of first recess Hm has the width direction width dimension formed to be smaller than at the downstream side, and the paper RP is suctioned stably to the medium support surface SM. Of course, it is not absolutely necessary to provide the ribs 35.

Figure 5:
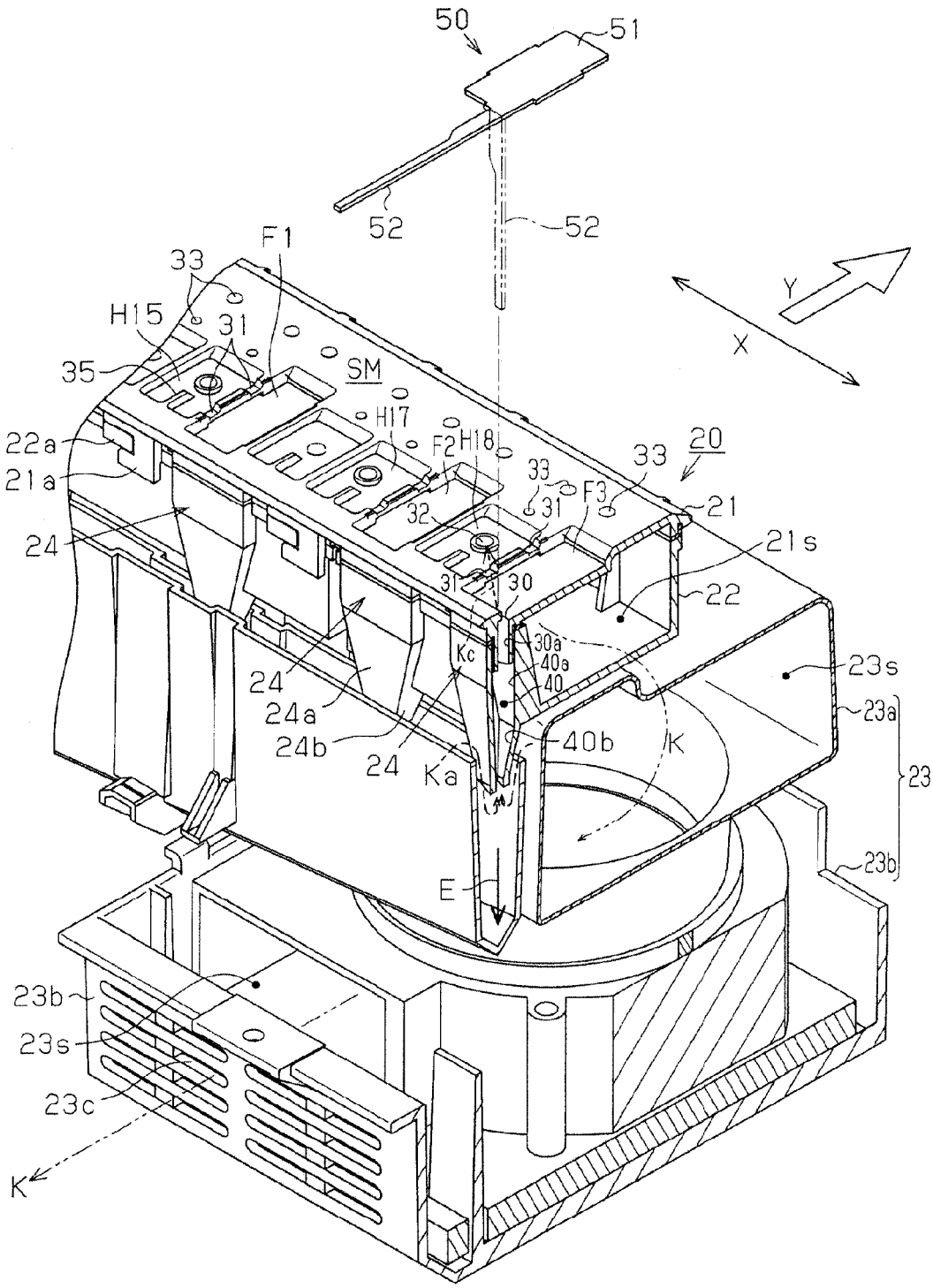
FIG. 5 is a perspective cross section view showing the medium support unit and the negative pressure generating unit in a state cut along line 5-5 in FIG. 4.

Next, as an example, we will describe the constitution of the flow path tube 24 connected to the vent hole 30 provided on the second recess F3 while referring to FIG. 5. Each flow path tube 24 connected to the vent hole 30 provided on each second recess Fn has the same constitution.

As shown in FIG. 5, with the vent hole 30 provided on the second recess F3, a tube shaped area 30*a* for which a ventilation part is provided extending toward the lower side which is the gravity direction side of the support surface forming member 21 On the support unit frame member 22 which is joined and fixed to the support surface forming member 21, the flow path tube 24 is formed in a cut away state for which the ventilation part is not in communication with the negative pressure chamber 21*s*.

On the flow path tube 24, the through path 40 which pierces through from an upper end part 40*a* to a lower end part 40*b* is formed, and the upper end part 40*a* is joined to the vent hole 30 so as to enclose the tube shaped area 30*a* from the outer periphery, while the lower end part 40*b* is inserted in the ink guiding member 29. As a result, as shown by the solid line arrow E in the drawing, the flow path tube 24 is provided so as to be able to have ink that flows in from the vent hole 30 side discharged to the gutter shaped part 29*a*.

Then, with this embodiment, with the flow path tube 24, the lower end part 40*b* is formed such that the cross section area of the through path 40, specifically the flow path cross section area in which ink flows, has taper shaped areas 24*a* and 24*b* which become smaller as they separate from the vent hole 30. With this embodiment, the flow path tube 24 is formed as an integral unit with the support unit frame member 22. Of course, these can also be formed as separate items.

Also, with this embodiment, the lower end part 40*b* of the flow path tube 24 (through path 40) is formed so there is a gap between it and the ink guiding member 29, and as shown by the thick dotted line arrow Ka in the drawing, from this gap, the air (atmosphere) can flow in from the lower end part 40*b* side to the through path 40 inside the flow path tube 24. Therefore, the air that flows into the flow path tube 24 rises toward the vent hole 30 side inside the through path 40, and flows into the depression formed part of the second recess F3 from the vent hole 30.

As shown by the thick dotted line arrow Kc in the drawing, the air that flows into the second recess F3 flows toward the adjacent first recess H18 in communication by the groove part 31, and after flowing in via this groove part 31, flows into the vacuum hole 32 provided on the first recess H18. After that, as shown by the double-dot-dash line arrow K in the drawing, the air that has flowed into the vacuum hole 32 flows from the negative pressure chamber 21*s* via the joining space 22*s* by which the support unit frame member 22 and the suction chamber 23*a* are joined in a state sealed by packing 55, and flows into the flow path space 23*s* formed inside the suction chamber 23*a* and inside the rotating fan 23*b*. Then, it is exhausted from the flow path space 23*s* through the exhaust port 23*c* provided on the rotating fan 23*b*.

With this embodiment, an absorptive material 50 for absorbing ink is equipped in each second recess Fn. The absorptive material 50 has an acceptance area 51 for accepting ink inserted in generally the entire area of the depression formed part of the second recess Fn, and an insertion area 52 formed connected to this acceptance area 51 and inserted in the through path 40 inside the flow path tube 24 from the vent hole 30. The insertion area 52 is formed in a form for which in a state inserted inside the through path 40 from the vent hole 30, a gap in which air flows is provided at the vent hole 30 and the through path 40 (see FIG. 6).

Figure 6:
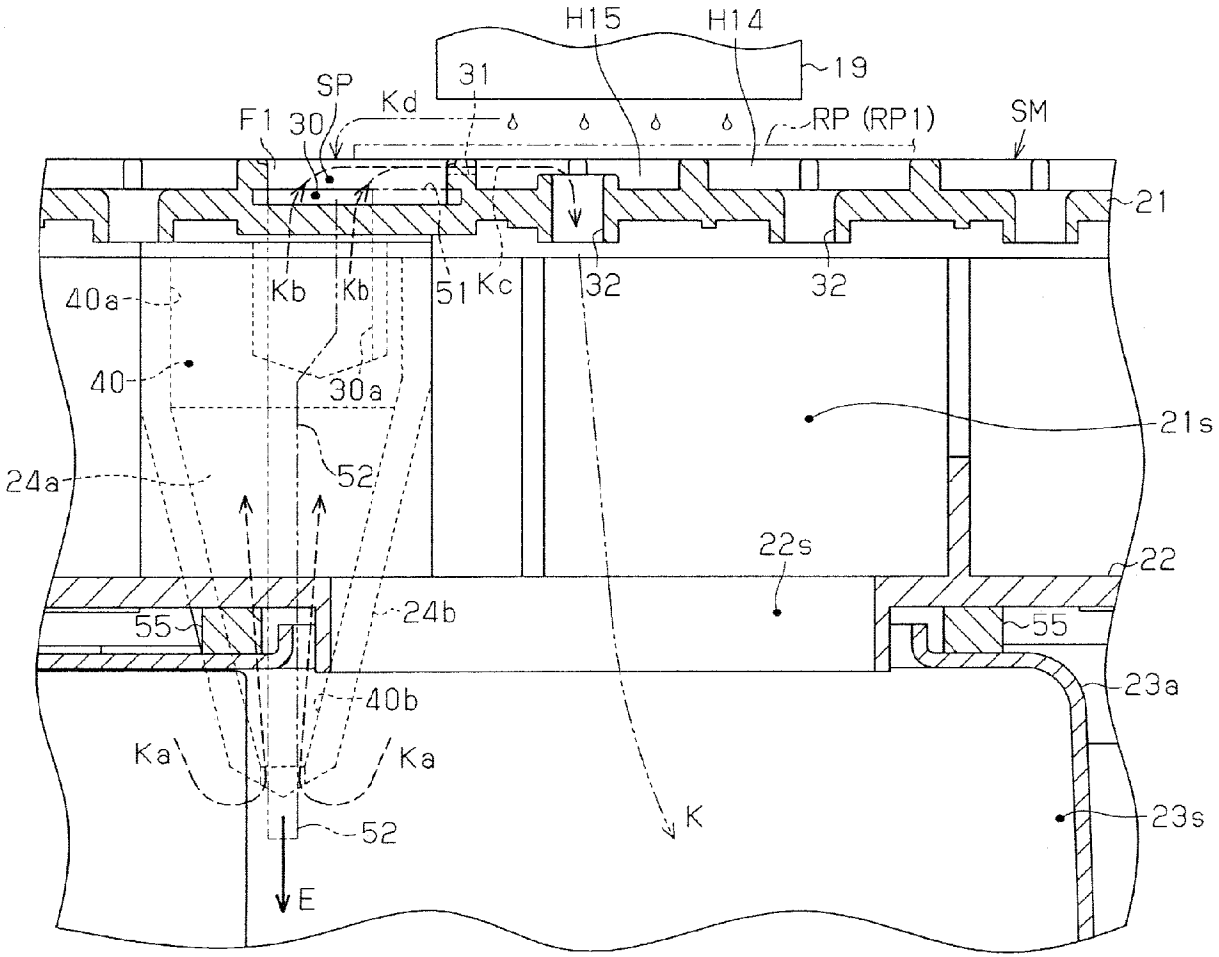
FIG. 6 is a partial cross section view showing the medium support unit and the negative pressure generating unit in a state cut at the surface orthogonal to the paper transport direction.

Next, we will describe the operation of the medium support unit 20 of this embodiment for which the first recesses Hm and the second recesses Fn are formed on the medium support surface SM in this way, using an example of a case when the paper RP1 is supported by suction on the medium support surface SM, while referring to FIG. 6. In FIG. 6, to make the explanation easier, a state cut at a plurality of surfaces orthogonal to the transport direction Y for the medium support unit 20 is shown as a single cross section.

As shown in FIG. 6, when the paper RP1 is suctioned to the medium support surface SM, with the second recess F1 positioned at the end part in the width direction of the paper RP1, at the depression formed part, an exposure space SP confronts the exposed opening part which is not covered by the end part of the paper RP1. Having done that, by the negative pressure given to the vacuum hole 32 provided in the first recess H15, the air is pulled via the groove part 31 from the second recess F1 side to the first recess H15 side, generating a flow of the air (atmosphere) that flows into this exposure space SP.

At this time, if by chance air does not flow from the vent hole 30 into the second recess F1, most of the air that flows into the exposure space SP becomes air that is positioned at the top side of the medium support surface SM. Because of this, as shown by the double-dot-dash line arrow Kd in the drawing, the air flows to the exposure space SP from the liquid ejection area side on which ink is ejected from the liquid ejection head 19. As a result, the air flowing in the liquid ejection area (arrow Kd) causes bending of the flight of the ink from the liquid ejection head 19, or mixing in of ink mist floating in conjunction with ejection of the ink. As a result, this can cause distortion of the image, or soiling of the back surface of the paper RP1 or of the medium support surface SM by ink.

In contrast to this, as shown by the dotted line arrow Ka in the drawing, with the medium support unit 20 of this embodiment, at the flow path tube 24, air flows from the lower end part 40*b* side of the through path 40 which is at a position separated from the liquid ejection area on which ink is ejected from the liquid ejection head 19. Then, as shown by the dotted line arrow Kb in the drawing, the air that has flowed into the through path 40 rises through the through path 40, passes through the tube shaped area 30*a* positioned at the upper end part 40*a* side, and flows from the vent hole 30 into the second recess F1. Furthermore, the air that has flowed into the second recess F1 is suctioned by the negative pressure given via the groove part 31, and flows through the depression formed part of the second recess F1 toward the vacuum hole 32 of the first recess H15, so as shown by the dotted line arrow Kc in the drawing, it flows from the exposure space SP through the groove part 31 into the vacuum hole 32 of the first recess H15.

As a result, most of the air that flows from the vent hole 30 into the second recess F1 becomes air that flows at the lower side of the paper RP1 supported on the medium support surface SM. As a result, there is a decrease in the air that flows from the liquid ejection area that is the top side of the paper RP1 into the exposure space SP.

The air that flows in the through path 40 at this time is given flow path resistance at the lower end part 40*b* by the taper shaped areas 24*a* and 24*b* formed on the flow path tube 24. Therefore, the speed and inflow volume of the air that flows from the vent hole 30 into the second recess F1 can be adjusted by adjusting the flow speed when flowing in the through path 40 using the given flow path resistance.

In addition, for example when the paper RP3 of a wider width than the paper RP1 is suctioned to the medium support surface SM as shown in FIG. 4, the second recess F1 has its opening covered by the paper RP3. In this case, the exposure space SP is not formed, so air is suctioned only from the vent hole 30 in relation to the second recess F1 and flows into the second recess F1. Therefore, there is a decrease in suction force of the paper RP3 at least at the second recess F1 and its adjacent first recess 1115 due to inflowing air, but by adjusting the flow path resistance given at the flow path tube 24, it is possible to maintain the suction force in relation to the paper RP3 within the practical use range. Of course, this kind of flow path resistance adjustment is also performed in the same way for the second recess F2.

With the embodiment noted above, it is possible to obtain the following kinds of effects.

(1) The air suctioned at the second recess Fn, after mainly flowing into the second recess Fn from the vent hole 30 positioned at the bottom surface side of the paper RP which is different from the liquid ejection area side (top surface side of the paper RP), flows from the second recess Fn through the groove part 31 into the first recess Hm, and after that, flows from the first recess Hm to the negative pressure generating unit 23 side. Because of that, ink is accepted at the second recess Fn, and also, the air pulled from the liquid ejection area side to the second recess Fn is decreased. Therefore, it is possible to accept ink ejected on the medium support unit 20 outside the paper RP while suppressing ink flight interference. Also, the air that passes from the second recess Fn through the groove part 31 via the first recess Hm flows to the negative pressure generating unit 23, so mist form floating ink can be suppressed from being pulled from the medium support unit 20 to the negative pressure generating unit 23 side.

(2) The vent hole 30 is arranged at the transport direction Y upstream side at the second recess Fn, so the air from the vent hole 30 at the transport direction Y upstream side of the liquid ejection area has a flow occur in the outflow direction from the second recess Fn to the transport direction downstream side. Therefore, the mist form ink that is generated in the transport direction Y downstream side of the liquid ejection area can be suppressed from being pulled to the second recess Fn positioned at the upstream side. In particular, when it is easy for mist form floating ink to mainly be generated at the transport direction downstream side of the liquid ejection area, it is possible to suppress the pulling of the mist form floating ink to the second recess Fn at a high rate.

(3) The vent hole 30 also functions as a discharge port of ink accepted by the second recess Fn, so it is possible to suppress suctioning of the ink ejected on the second recess Fn to the first recess Hm.

(4) The flow path tube 24 provided on the medium support unit 20 has taper shaped areas 24*a* and 24*b* for which the flow path cross section area becomes smaller as they separate from the vent hole 30, so it is possible to adjust the flow path resistance of the air suctioned from the flow path tube 24. As a result, it is possible to adjust the volume of air that flows from the vent hole 30 via the second recess Fn to the first recess Hm.

(5) Inside the flow path tube 24, an absorptive material is equipped that is formed connected to the second recess Fn and also absorbs ink exhausted from the vent hole 30, so it is possible to reliably flow the ink ejected from the liquid ejection head 19 to the second recess Fn to the downstream side separating from the vent hole 30 inside the flow path tube 24 without reverse flow together with the air from the flow path tube 24 side to the vent hole 30 side. Therefore, the soiling of the medium support surface SM by ink is suppressed at a high rate.

(6) The vacuum hole 32, the groove part 31, and the vent hole 30 are arranged aligned on generally a straight line seen in the normal line direction of the medium support surface SM, so the air suctioned from the vent hole 30 flows smoothly through the groove part 31 to the vacuum hole 32. Therefore, it is possible to reduce the air that is pulled from the liquid ejection area side.

The embodiment noted above can be modified as noted below.

With the embodiment noted above, the vent hole 30 formed on the second recess Fn was provided at the side separated from the paper RP at the transport direction Y upstream side end part of the depression formed part of the second recess Fn, but it is also possible to provide at least a portion of it at a position overlapping the ejection medium seen in the normal line direction view of the medium support surface. We will describe this modification example while referring to FIGS. 7A and 7B.

Figure 7A:
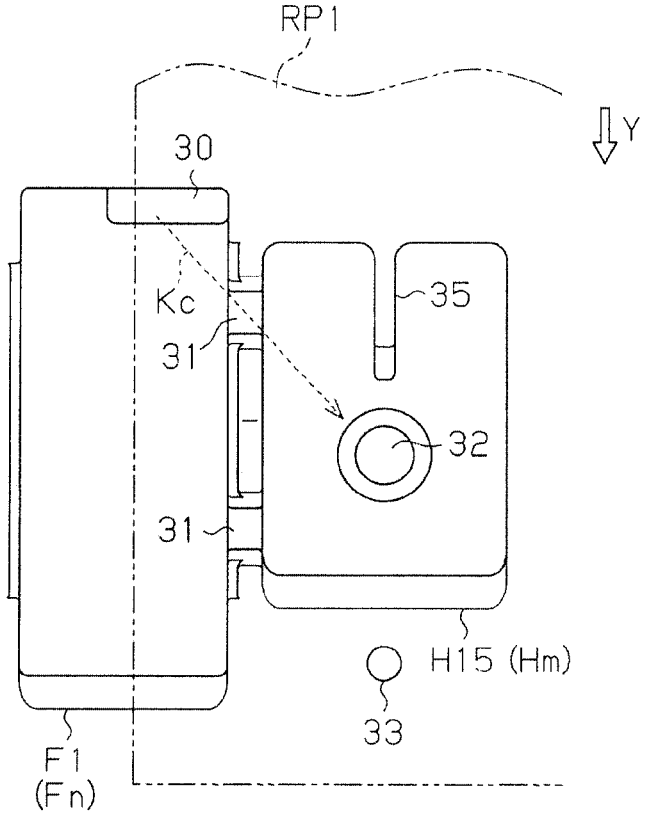
FIGS. 7A and 7B are both plan views showing modification examples regarding the vent hole forming positions.

As shown in FIG. 7A, with this modification example, it is also possible to provide the vent hole 30 formed at the second recess F1 provided according to the width direction end part of the paper RP1 (double dot line in the drawing) at the side near the paper RP of the transport direction Y upstream side end parts at the depression formed part of the second recess Fn, for example. Specifically, the vent hole 30 is formed so as to be close to the vacuum hole 32 of the first recess Hm. Then, at least one groove part 31 is formed on the straight line (dotted line arrow Kc in the drawing) connecting the vent hole 30 and the vacuum hole 32. By working in this way, at the width direction end part of the paper RP1 transported during borderless printing, air flows smoothly from the vent hole 30 on the bottom surface side of the paper RP1 toward the vacuum hole 32.

Alternatively, it is also possible to provide the vent hole 30 formed on the second recess Fn provided according to the width direction end parts of the paper RP at the end part near the paper RP in the width direction orthogonal to the transport direction Y at the depression formed part of the second recess Fn. Furthermore, in this case, the vent hole 30 does not absolutely have to be arranged at the transport direction upstream side of the second recess Fn, and can also be a rectangle for which the shape has the lengthwise direction in the direction along the transport direction Y.

Figure 7B:
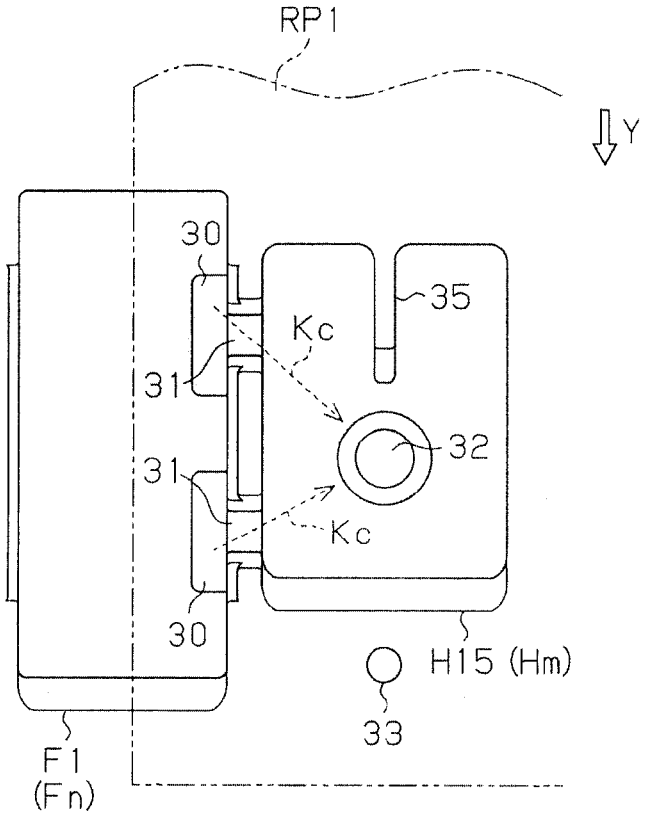

For example, as shown in FIG. 7B, a plurality of (two) rectangular vent holes 30 with the transport direction Y as the lengthwise direction are formed, and groove parts 31 are respectively formed on the respective straight lines (dotted line arrow in the drawing) connecting each vent hole 30 and vacuum hole 32. By working in this way, at the width direction end part of the paper RP1 transported during borderless printing, air flows smoothly from the vent hole 30 toward the vacuum hole 32 on the bottom surface side of the paper RP1.

With this modification example, in addition to the effects (1) through (6) with the embodiment noted above, the following effect is exhibited.

(7) Air (atmosphere) flows at the bottom surface side opposite to the top surface side which is the liquid ejection area in relation to the paper RP1, so it is possible to reduce the air pulled from the top surface side, specifically, the liquid ejection area side.

With the modification noted above and the embodiment noted above, the shape of the vent hole 30 is not limited to being a rectangle, but can also for example be a circle or oval shape, or a polygon shape.

With the embodiment noted above, the vent hole 30 does not absolutely have to be provided at a position for which at least a portion overlaps with the paper RP in the normal line direction view of the medium support surface SM. For example, when the depression formed part of the second recess Fn is formed deeply from the medium support surface SM, without depending on the position of the vent hole 30, it is possible to suppress flowing of the air that flows into the second recess Fn from the vent hole 30 to the top surface side of the paper RP. Therefore, the flow of the air on the top surface side into the depression formed part of the second recess Fn is suppressed.

With the embodiment noted above, the vacuum hole 32, the groove part 31, and the vent hole 30 provided on the first recess Hm do not absolutely have to be arranged aligned on a generally straight line with the normal line direction view of the medium support surface SM. As long as the constitution is such that the air flowing in from the vent hole 30 to the second recess Fn flows smoothly via the groove part 31 to the first recess Hm, the same effects are exhibited as the effect of the embodiment noted above.

With the embodiment noted above, the groove part 31 was used as the communication unit between the first recess Hm and the second recess Fn, but the invention is not restricted to this, and it is also possible to form a communication unit. For example, this can also be a hole formed between the first recess Hm and the second recess Fn. In short, any shape is acceptable as long as the depression shaped part of the first recess Hm and the depression shaped part of the second recess Fn are in communication.

With the embodiment noted above, it is not absolutely necessary to equip the absorptive material 50 (insertion area 52) that absorbs the ink discharged from the vent hole 30 inside the flow path tube 24. For example, when the shape of the inside of the flow path tube 24 is such that, even without the absorptive material 50 (insertion area 52), the ink that flows in the flow path tube 24 will not have reverse flow occur due to air flowing in the reverse direction as the ink inside the flow path tube 24 toward the vent hole 30 side, the absorptive material 50 is not necessary.

With the embodiment noted above, the flow path tube 24 does not absolutely have to have the taper shaped areas 24*a* and 24*b* for which the ink flow path cross section area becomes smaller as they separate from the vent hole 30. For example, it is also possible to have a flow path tube 24 for which the flow path cross section area is the same shape from the vent hole 30 to the ink guiding member 29. Alternatively, it is also possible to be a flow path tube 24 having an orifice shape for which the flow path cross section area gets smaller once as it separates from the vent hole 30 and then again becomes larger. In short, it is sufficient as long as it is a shape for which it is possible to adjust the flow (flow speed) of air to the vent hole 30.

With the embodiment noted above, the vent hole 30 does not absolutely have to be a discharge port for discharging the ink accepted by the second recess Fn from the second recess Fn. Of course, in this case, it is preferable to equip an ink discharge port separately from the vent hole 30 at the second recess Fn.

With the embodiment noted above, the ejection medium is not limited to being paper (roll paper), and can also be a sheet type member which uses a material such as a metal plate, resin plate, fabric or the like. As long as it is a member for which it is possible to form an image or the like using the liquid ejected from the liquid ejection head 19, it can be used as the ejection medium.

With the embodiment noted above, with the liquid ejection head 19, the liquid storage container in which the ejected liquid is housed can be an on-carriage type which is placed on the carriage 18, or the liquid storage container can also be an off-carriage type which is not placed on the carriage 18. Alternatively, this is not limited to being a serial type printer for which the carriage 18 moves in the main scan direction X, but can also be a line head type printer for which it is possible to do maximum width range printing of the paper RP even with the liquid ejection head 19 remaining fixed.

With the embodiment noted above, the liquid ejection device was put into specific form as the printer 11 for ejecting ink as the liquid, but it is also possible to make it into a specific form as a liquid ejection device that ejects or discharges a liquid other than ink. Various types of liquid ejection device equipped with a liquid ejection head or the like for discharging tiny volume droplets can be appropriated for this. Droplets means the state of liquid discharged from the aforementioned liquid ejection device, and includes granular shapes, tear shapes, and threadlike shapes with a tail. Also, what is called liquid here is sufficient as long as it is a material that can be ejected by the liquid ejection device. For example, it is sufficient as long as it is an item in a state when the property is liquid phase, and includes not only liquid bodies with high or low viscosity, fluid bodies such as sol, gel water, other inorganic solvents, organic solvents, solutions, liquid resin, liquid metal (metal melt), or a liquid as one state of a substance, but also includes items such as items for which particles of functional materials consisting of a solid such as a pigment, metal particle or the like is dissolved, dispersed, or blended in a solvent. Also, as a representative example of a liquid, we can list the ink or liquid crystal or the like such as those described with the embodiment noted above. Here, ink includes typical water based inks, oil based inks, as well as various liquid compositions such as gel ink, hot melt ink and the like. As a specific example of the liquid ejection device, for example, there are liquid ejection devices which eject liquid including materials such as electrode materials or coloring materials or the like in a dispersed or dissolved form used in manufacturing items such as liquid crystal displays, EL (electro luminescence) displays, surface light emitting displays, color filters and the like. Alternatively, it is also possible to be a liquid ejection device for ejecting bioorganic material used for biochip manufacturing, a liquid ejection device for ejecting a liquid that will be a sample used for a precision pipette, a textile printing device, a micro dispenser or the like. Furthermore, it is also possible to use a liquid ejection device for ejecting lubricating oil with a pinpoint on precision machines such as watches, cameras or the like, a liquid ejection device for ejecting a transparent resin liquid such a ultraviolet curing resin or the like for forming a miniature hemispheric lens (optical lens) used for optical communication elements or the like on a substrate, or a liquid ejection device for ejecting an acid or alkaline or the like etching fluid for etching a substrate or the like. Then, it is possible to apply the present invention to any one type of liquid ejection device among these.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid ejection device comprising:

a transport unit configured and arranged to transport an ejection medium;

a medium support unit arranged on a downstream side of the transport unit with respect to a transport direction of the ejection medium, and having a medium support surface on which the ejection medium is supported by suction using negative pressure;

a liquid ejection head configured and arranged to eject liquid on the ejection medium supported on the medium support unit; and a negative pressure generating unit configured and arranged to generate the negative pressure to the medium support unit, the medium support unit including a plurality of first recesses arranged on the medium support surface with the first recesses being in communication with the negative pressure generating unit, and a plurality of second recesses arranged on the medium support surface so that the first recesses and the second recesses are aligned in a width direction orthogonal to a transport direction, the second recesses being configured and arranged to accept the liquid ejected from the liquid ejection head, each of the second recesses includes a communication unit communicating with one of the first recesses and a vent hole configured and arranged to allow ventilation without being in communication with the negative pressure generating unit.

2. The liquid ejection device according to claim 1, wherein the vent hole is arranged on an upstream side in the second recess with respect to the transport direction.

3. The liquid ejection device according to claim 1, wherein the vent hole serves as a discharge port for discharging the liquid accepted by the second recess from the second recess.

4. A liquid ejection device according to claim 3, wherein the medium support unit further includes a flow path tube connected to the vent hole and through which the liquid discharged from the second recess flows, and the flow path tube has a taper shaped area in which a cross section area of a flow path of the flow path tube becomes smaller as a distance from the vent hole becomes larger.

5. The liquid ejection device according to claim 4, wherein the flow path tube includes an absorptive material disposed inside the flow path tube, the absorptive material being in communication with the second recess to absorb the liquid discharged from the vent hole.

6. The liquid ejection device according to claim 1, wherein at least one of the first recesses includes a vacuum hole in communication with the negative pressure generating unit, and the vacuum hole, the communication unit, and the vent hole are arranged generally along a straight line when viewed along a normal line direction of the medium support surface.

7. The liquid ejection device according to claim 1, wherein the vent hole is disposed at a position that at least partially overlaps the ejection medium when viewed along a normal line direction of the medium support surface.

* * * * *